US008636167B2

(12) United States Patent
Hajichristou et al.

(10) Patent No.: US 8,636,167 B2
(45) Date of Patent: Jan. 28, 2014

(54) SELF-ACTUATING CLOSURE MECHANISMS FOR CLOSEABLE ARTICLES

(76) Inventors: Louis Hajichristou, Agioi Trimithias (CY); Christiana Hajichristou, Agioi Trimithias (CY)

( * ) Notice: Subject to any disclaimer, the term of this patent is extended or adjusted under 35 U.S.C. 154(b) by 42 days.

(21) Appl. No.: 13/025,834

(22) Filed: Feb. 11, 2011

(65) Prior Publication Data

US 2011/0132907 A1 Jun. 9, 2011

Related U.S. Application Data

(63) Continuation-in-part of application No. 12/497,559, filed on Jul. 3, 2009.

(60) Provisional application No. 61/087,814, filed on Aug. 11, 2008, provisional application No. 61/107,546, filed on Oct. 22, 2008, provisional application No. 61/141,395, filed on Dec. 30, 2008.

(51) Int. Cl.
*B65D 41/36* (2006.01)
*B65D 51/00* (2006.01)

(52) U.S. Cl.
USPC ..... 220/230; 220/298

(58) Field of Classification Search
USPC ..... 220/230, 298; 215/337, 339, 329
See application file for complete search history.

(56) References Cited

U.S. PATENT DOCUMENTS

| | | | |
|---|---|---|---|
| 2,717,096 | A | 9/1955 | Henderson |
| 3,478,911 | A | 11/1969 | Hedgewick et al. |
| 3,931,891 | A | 1/1976 | Peppler |
| 3,961,721 | A | 6/1976 | Gordon et al. |

(Continued)

FOREIGN PATENT DOCUMENTS

| | | |
|---|---|---|
| CH | 658438 | 11/1986 |
| CH | 658438 A | 11/1986 |

(Continued)

OTHER PUBLICATIONS

"Medium Size Clear Plastic Container with a Strong Magnetic Lid thst [sic] will Stick to Most Metals;" <www.thisnext.com/item/3A967EI5/3C73259E/Medium-size-Clear-Plastic>.

"Medium Size Clear Plastic Container with a Strong Magnetic Lid thst [sic] will Stick to Most Metals;" <www.thisnexl.com/item/3A967EI5/3C73259E/Medium-size-Clear-Plastic>.

*Primary Examiner* — Mickey Yu
*Assistant Examiner* — Niki Eloshway
(74) *Attorney, Agent, or Firm* — Hughes Hubbard & Reed LLP

(57) ABSTRACT

A container assembly comprising a body and interlocking and self-actuating lid. The body has a bottom and at least one sidewall extending generally upwardly and includes at least one body interlock piece. The lid includes a lid interlock piece configured to releasably engage the body interlock piece. A first magnet is coupled to the body and a second magnet is coupled to the lid. The first and second magnet magnetically generate a first relative movement of the body and lid in a first direction when the first and second magnet are in a first orientation, wherein the first relative movement operatively engages the lid interlock piece with the body interlock piece. Additionally, the interengagement of the lid interlock piece and the body interlock piece during the first relative movement of the body and lid mechanically generate a second relative movement of the body and lid in a second direction.

18 Claims, 15 Drawing Sheets

(56) References Cited

U.S. PATENT DOCUMENTS

| | | | | |
|---|---|---|---|---|
| 4,223,799 | A | 9/1980 | Eyster et al. | |
| 4,489,842 | A | 12/1984 | Bobrove | |
| 4,697,903 | A * | 10/1987 | Koda et al. | 396/536 |
| 5,038,829 | A | 8/1991 | Panella | |
| 5,199,597 | A | 4/1993 | Gladish | |
| 5,534,663 | A | 7/1996 | Rivers et al. | |
| 5,957,313 | A | 9/1999 | Bouan | |
| 6,336,567 | B1 | 1/2002 | Hyobu | |
| 6,382,450 | B1 | 5/2002 | De Rosa et al. | |
| 6,491,177 | B1 | 12/2002 | Hyobu | |
| 6,659,516 | B2 | 12/2003 | Wang et al. | |
| 6,673,319 | B2 * | 1/2004 | Dean et al. | 422/547 |
| 6,961,977 | B2 * | 11/2005 | Seidler | 16/320 |
| 7,156,252 | B2 | 1/2007 | Morin | |
| 7,172,101 | B2 | 2/2007 | Find | |
| 7,607,430 | B2 | 10/2009 | Davis | |
| 7,610,937 | B1 * | 11/2009 | Trimble et al. | 138/89.4 |
| 7,770,601 | B2 | 8/2010 | Perry | |
| 2002/0130128 | A1 | 9/2002 | Berglund | |
| 2004/0178200 | A1 | 9/2004 | Langlois et al. | |
| 2005/0139565 | A1 * | 6/2005 | Cohn | 215/11.1 |
| 2008/0264944 | A1 | 10/2008 | Hui | |

FOREIGN PATENT DOCUMENTS

| | | |
|---|---|---|
| DE | 2064615 | 12/1971 |
| DE | 3921540 | 3/1991 |
| DE | 3921540 A1 | 3/1991 |
| EP | 0630823 | 12/1994 |
| FR | 2623166 | 5/1989 |
| GB | 2264975 | 9/1993 |
| GB | 2264975 A | 9/1993 |
| JP | 1167055 | 6/1989 |

* cited by examiner

SELF-ACTUATING CLOSURE MECHANISMS FOR CLOSEABLE ARTICLES

CROSS REFERENCE TO RELATED APPLICATIONS

This application is a continuation-in-part of co-pending, U.S. patent application Ser. No. 12/497,559, filed Jul. 3, 2009, which claims priority to U.S. Provisional Patent Application Ser. No. 61/087,814, filed Aug. 11, 2008 and U.S. Provisional Patent Application Ser. No. 61/107,546, filed Oct. 22, 2008, and U.S. Provisional Patent Application Ser. No. 61/141,395, filed Dec. 30, 2008, the disclosures of each are hereby incorporated by reference in their entireties.

BACKGROUND OF THE DISCLOSED SUBJECT MATTER

1. Field of the Disclosed Subject Matter The disclosed subject matter is in the field of the mechanical arts, and more particularly concerns self-actuating closure mechanisms for articles having components that are mutually closable, more particularly including self-actuating closure mechanisms that may be rotationally engaged, including without limitation embodiments in the form of lidded containers with self-closing mechanisms that operate to automatically mechanically lock and seal the container, no matter how the lid is placed on the container.

2. Description of Related Art

An example of an article having closable components that may be rotationally engaged is a jar with a threaded lid. Common kitchen jars are often dropped and broken because the lid has not been properly threaded by the previous user.

Currently, most containers use a standard threaded locking/sealing mechanism or a latch, both of which require specific force to achieve a lock and seal. In the event this required force is not applied properly or fully, two main issues may arise: (1) the seal is not achieved, thereby potentially compromising the contents of the container, or (2) the lock is not adequate, thereby potentially risking the container and contents should the container be picked up by the lid.

A prior solution to this problem is to provide containers with a lid having a press-shut clip closure. However, press fit clip lids are only viable for light weight containers and contents. They must be actively pressed shut. Also, most clip lids do not provide an adequate seal.

Accordingly, a need exists for a self-closing container providing an effective and robust seal for a wide range of contents. More generally, a need exists for more modern closure mechanisms that are self-actuating and convenient, yet provide a strong and positive closure.

SUMMARY OF THE DISCLOSED SUBJECT MATTER

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

To achieve these and other advantages and in accordance with the purpose of the disclosed subject matter, as embodied and broadly described, the disclosed subject matter includes a container assembly comprising a body having a bottom and at least one sidewall extending generally upwardly and a body interlock piece. A lid is included which has an lid interlock piece and configured to releasably engage the body. Additionally, at least a first magnet is coupled to the body and a at least a second magnet is coupled to the lid. The first and second magnet configured to generate a first relative movement of the body and lid in a first direction when the first and second magnet are in a first orientation, wherein the first relative movement operatively engages the lid interlock piece with the body interlock piece. The first relative movement of the body and lid generate a second relative movement of the body and lid in a second direction. The relative movement in the first direction can be generally rotational movement or generally linear movement. The relative movement in the second direction is generally orthogonal to the relative movement in the first direction. The second relative movement displaces the lid generally downward with respect to the body. The body interlock piece can be configured with a top and bottom portion, the bottom portion having width greater than the top portion.

In accordance with another aspect of the disclosed subject matter, a container assembly comprises a body, with the body including a bottom and at least one sidewall extending generally upwardly. A lid is included and configured to matingly engage the body. At least a first magnet is coupled to the body and at least a second magnet is coupled to the lid. The first and second magnet are configured to generate a repelling force when the lid is in a first orientation with respect to the body, wherein the repelling force is greater than the weight of the lid.

Additionally, the lid includes a lid interlock piece, with the lid interlock piece slidingly received in a guide portion of the body. The guide portion extends a distance along a periphery of the body and the lid interlock piece matingly engages the guide portion at a first location of the body. The lid interlock piece disengages the guide portion at a second location of the body. The first and second magnet are configured to generate a first relative movement of the body and lid in a first direction at the first location of the body, with the lid interlock piece matingly engaged with the body interlock piece through at least a portion of the first relative movement. The first and second magnet are configured to generate a second relative movement of the body and lid in a second direction at the second location of the body. The relative movement in the first direction is generally rotational movement, or generally linear movement. The second relative movement displaces the lid generally upward with respect to the body.

In accordance with another aspect of the disclosed subject matter, a container assembly comprises a body including a bottom and at least one sidewall extending generally upwardly. A guide portion extends along at least a portion of a periphery of the body and includes at least a first and second path, wherein at least one of the first and second paths include at least one obstruction. A lid is included with a lid interlock piece and configured to releasably engage the guide portion. The lid interlock is received in a first path of the guide portion during closure of the container and the lid interlock received in a second path of the guide portion during opening of the container. At least a first magnet is coupled to the body and at least a second magnet is coupled to the lid. The first and second magnet are configured to generate a first relative movement of the body and lid in a first direction when the first and second magnet are in a first orientation, and the first and second magnet generate a second relative movement of the body and lid in a second direction when the first and second magnet are in a second orientation. The first and second paths are discontinuous or non-linear. Additionally, the guide portion includes a plurality of second paths. The relative movement in the first direction is generally rotational movement and the second relative movement displaces the lid generally upward with respect to the body.

It is to be understood that both the foregoing general description and the following detailed description are exemplary and are intended to provide further explanation of the disclosed subject matter claimed.

The accompanying drawings, which are incorporated in and constitute part of this specification, are included to illustrate and provide a further understanding of the method and system of the disclosed subject matter. Together with the description, the drawings serve to explain the principles of the disclosed subject matter.

BRIEF DESCRIPTION OF THE DRAWINGS

FIG. 1A is a perspective partially transparent view of the container illustrated throughout the various other views of FIGS. 1A-1J.

FIG. 1B is a partially transparent side view of the container of FIG. 1A.

FIG. 1C is a partially transparent top view of the container of FIG. 1A.

FIG. 1D is a larger partially transparent side view of the container of FIG. 1A.

FIG. 1E is a detailed view of area 1E of FIG. 1D.

FIG. 1F is a partially transparent side view of the container of FIG. 1A.

FIG. 1G is a top view of the container of FIG. 1A.

FIG. 1H is a cross-sectional side view of the container of FIG. 1A as taken along lines 1H-1H in FIG. 1F.

FIG. 1I is a detailed view of area 1I of FIG. 1H.

FIG. 1J is a partially transparent cross-sectional view of the container of FIG. 1A as taken along lines 1J-1J in FIG. 1G.

DETAILED DESCRIPTION OF THE PREFERRED EMBODIMENT

The following is a description of alternative preferred embodiments of the disclosed subject matter. These embodiments are illustrative only, and the disclosed subject matter, as defined by the claims, is by no means limited to particular examples shown. For example, certain preferred embodiments are described in relation to an implementation with specific magnetic attraction elements, pins, and channels, but it should be appreciated that the disclosure that follows was intended to enable those skilled in the art readily to apply the teachings set forth to other commonly available hardware and materials. The specific features of any particular embodiment should not be understood as limiting the scope of what is claimed.

The specific embodiments presented herein for purposes of illustrating the disclosed subject matter may be implemented in magnetically and mechanically engaging closures or fastening mechanisms. Some exemplary embodiments include a lid and body assembly in which rotational and/or translational movement is achieved by the interaction of the magnetic force and the cooperation of the mechanical structures. An exemplary embodiment of an industrial application of the disclosed subject matter is for use in a variety of consumer goods, including food serving or storage containers. However, it is to be understood that the disclosure of the present subject matter is not limited to containers, and can be embodied in any closure or fastening system.

An illustrative embodiment of the closure system and assembly having a rotationally engaged closure in accordance with one embodiment of the disclosed subject matter, is shown as article 1 in FIGS. 1A-1J. In this embodiment, the closure assembly comprises a body 2 (or interchangeably referred to as a base), and a lid 3.

We will sometimes refer herein to the "top" of body 2, and such references will be to the end of body 2 that faces lid 3 in a mutually closed position. Similarly, references to the "bottom" of lid 3 refer to the portion of lid 3 that faces body 2 in a mutually closed position. The term "axis" as used herein will refer to the rotational axis defined when rotating lid 3 to engage/disengage with body 2. "Axial" will mean aligned with the axis, and "radial" and/or "circumferential" will refer to positions in planes perpendicular to the axis.

Figure 1A:
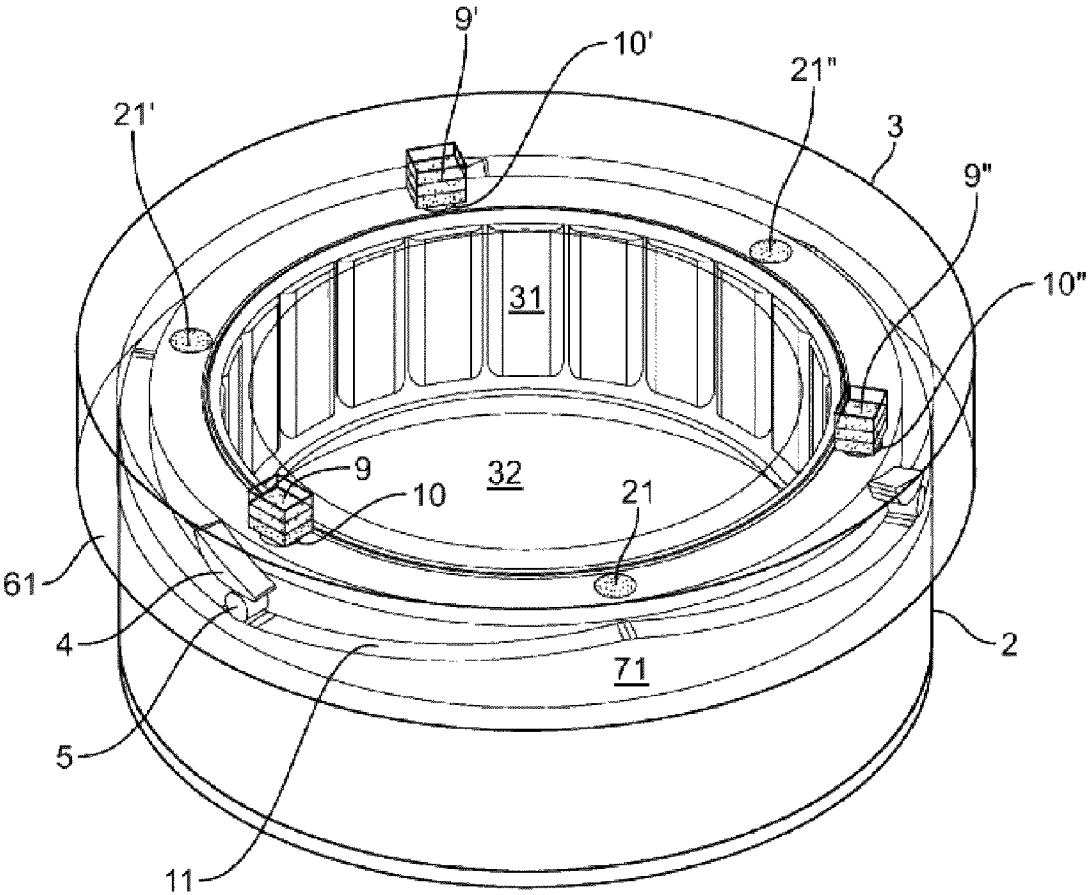
FIGS. 1A-1J show various views of an illustrative container in accordance with one embodiment of the disclosed subject matter.
Figure 1B:
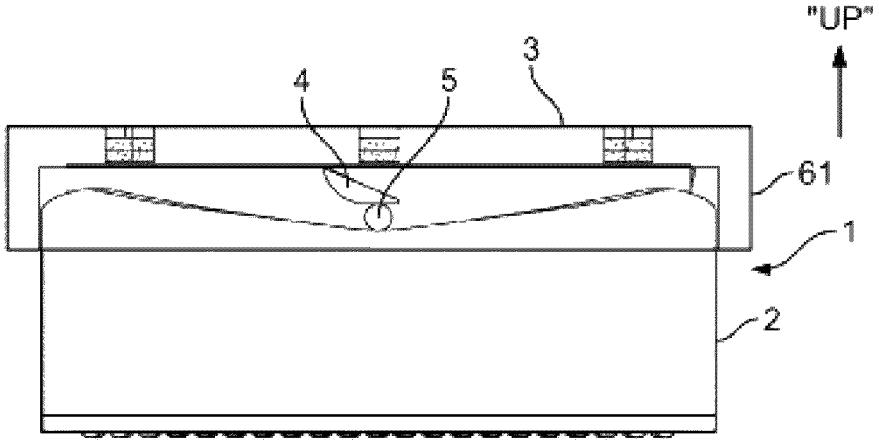
Figure 1C:
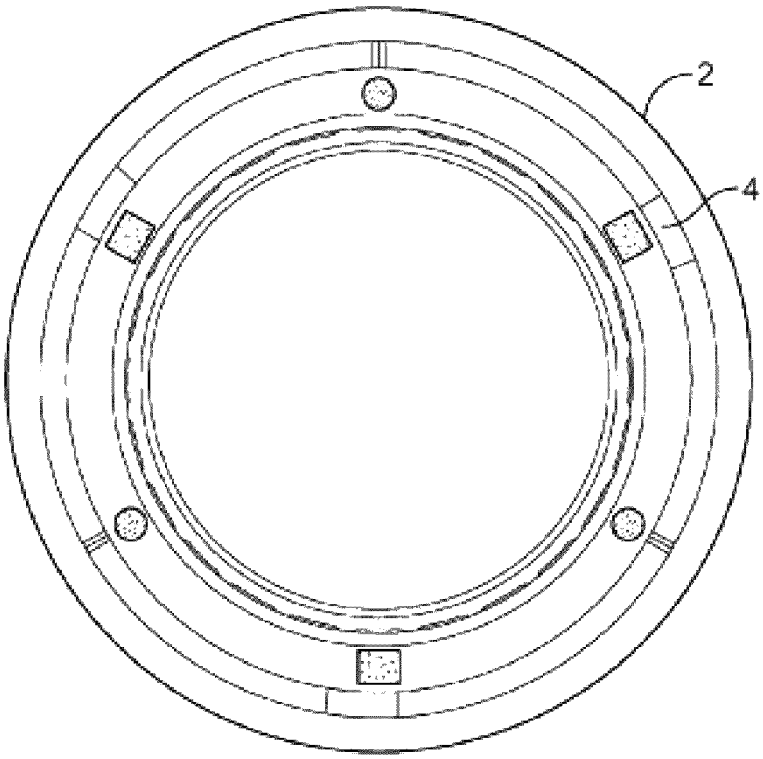
Figure 1D:
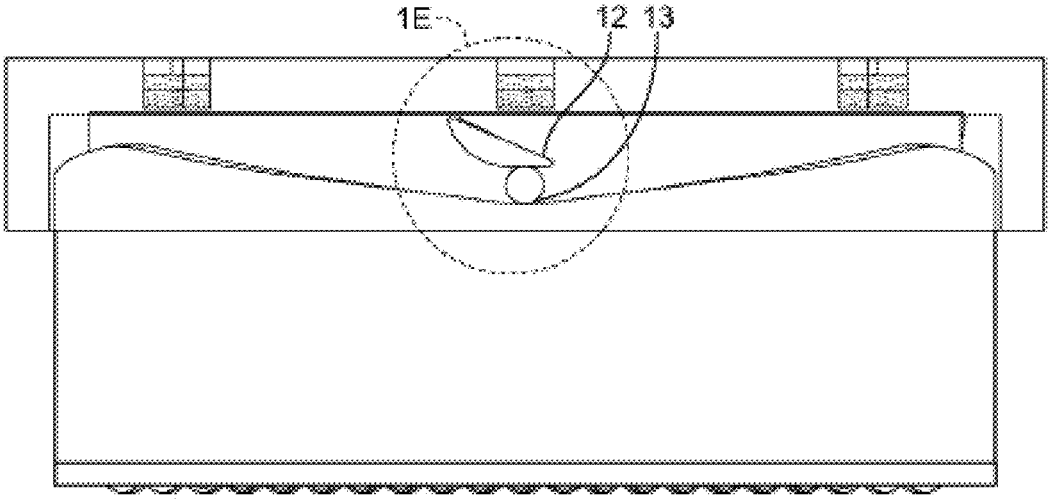
Figure 1E:
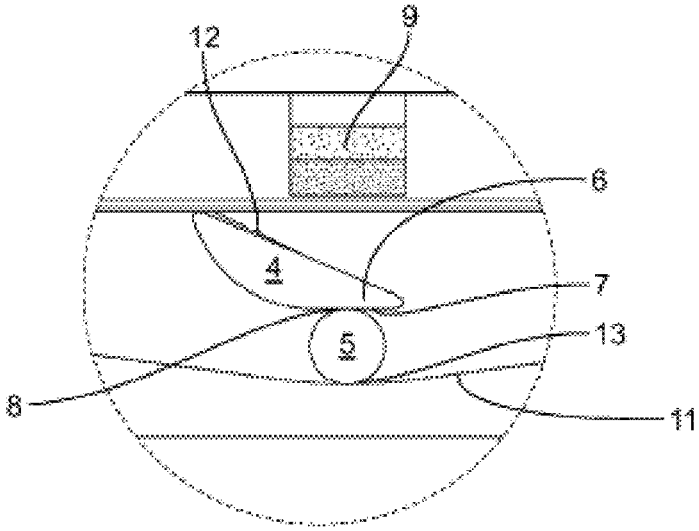
Figure 1F:
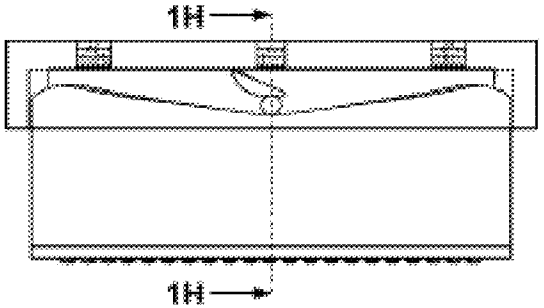
Figure 1H:
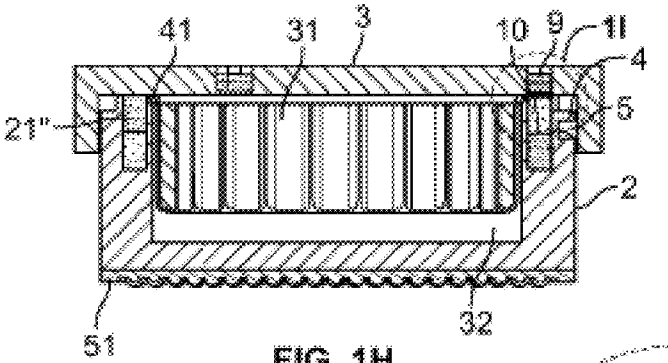
Figure 1G:
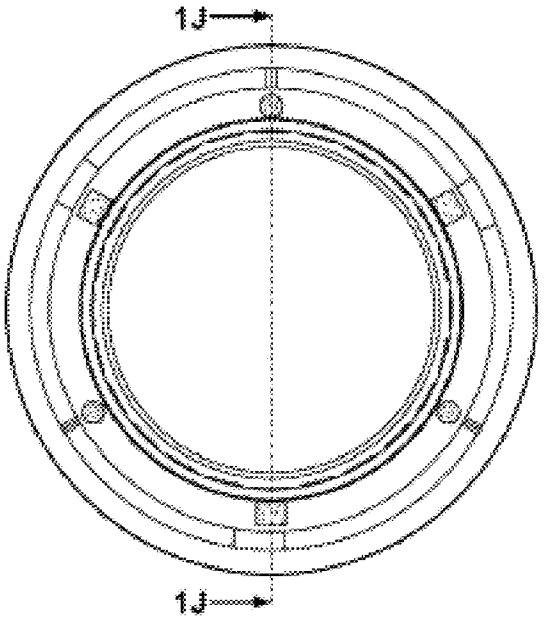
Figure 1I:
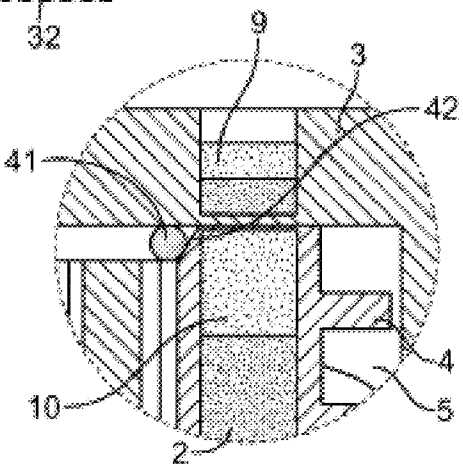
Figure 1J:
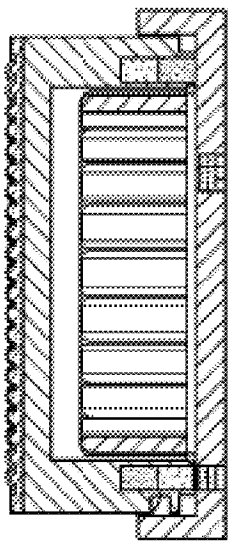
Figure 2:
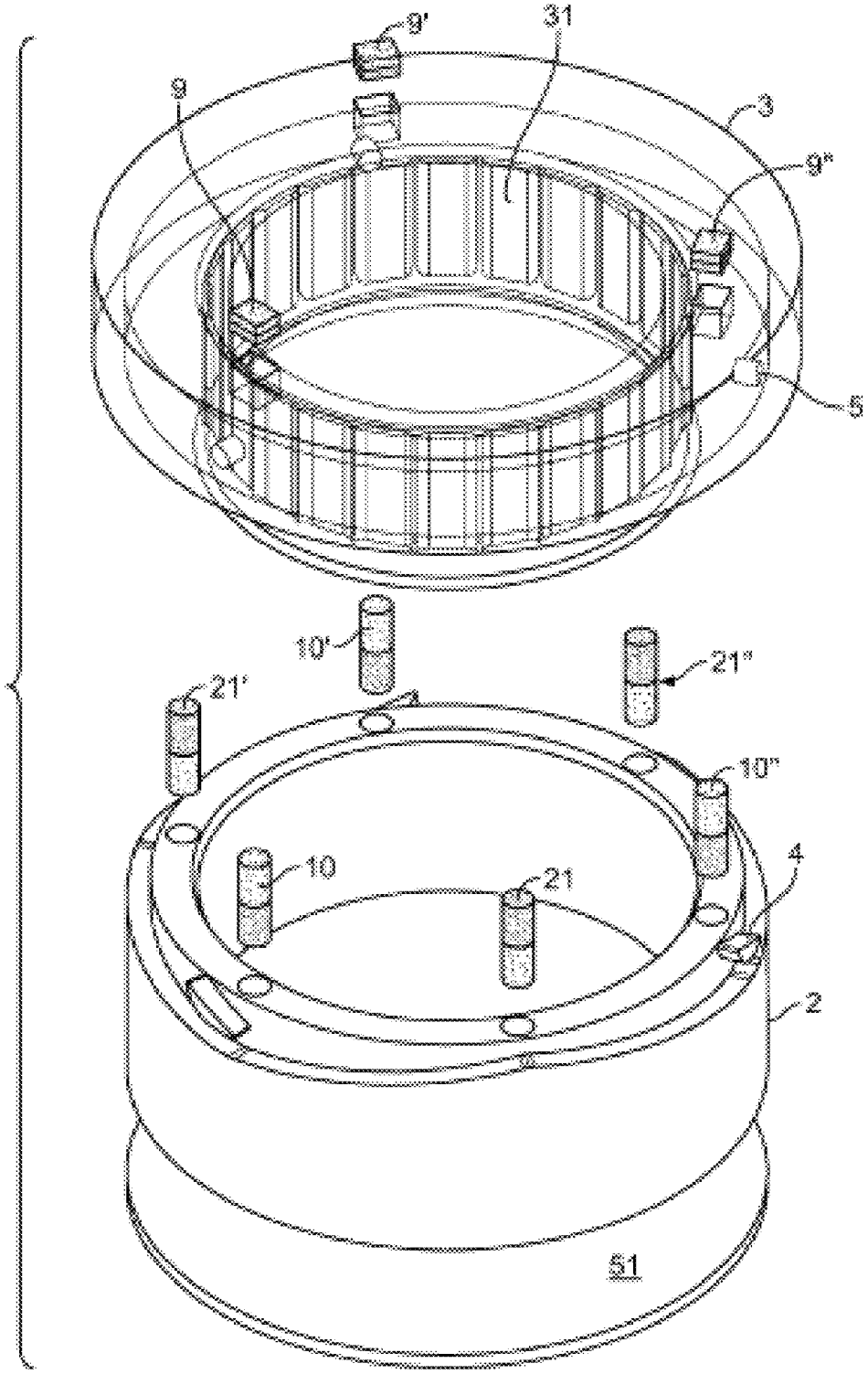
FIG. 2 is an exploded parts view of the container of FIG. 1A, in a partially transparent perspective view.
Figure 3A:
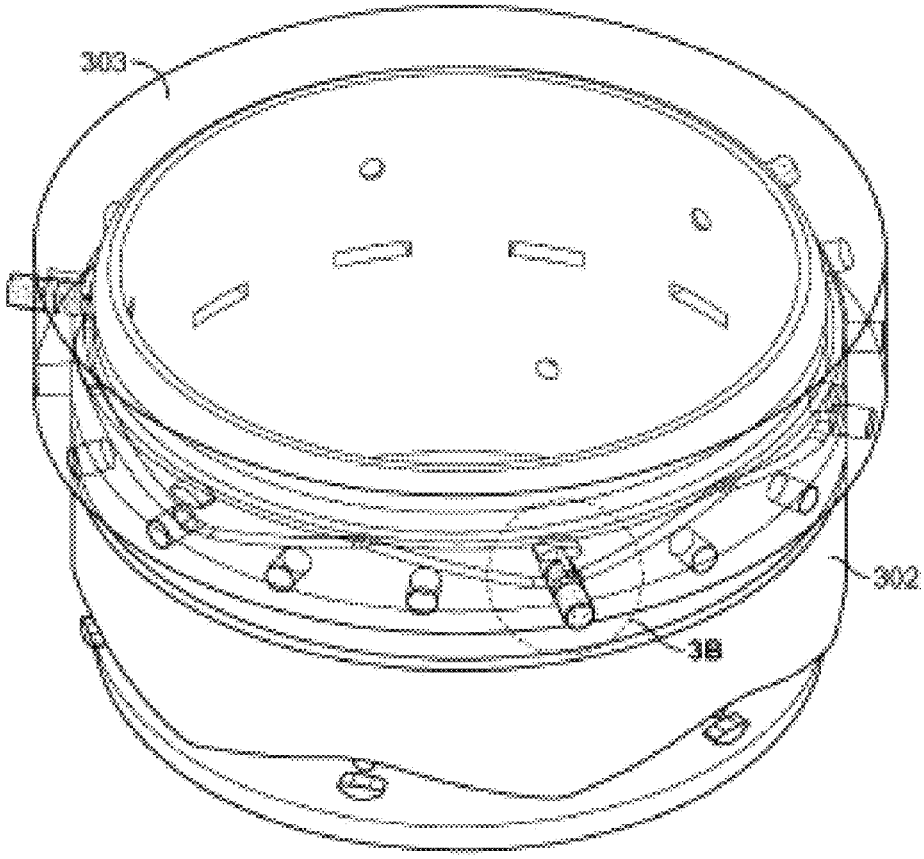
FIGS. 3A-3D show another illustrative container in accordance with an alternate embodiment.
Figure 3B:
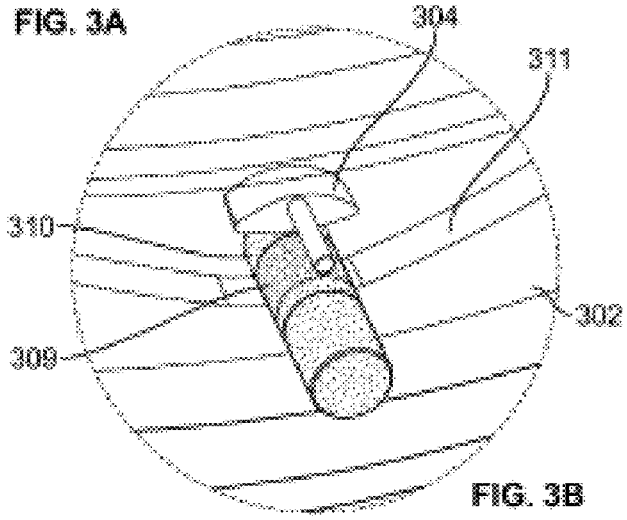
Figure 3C:
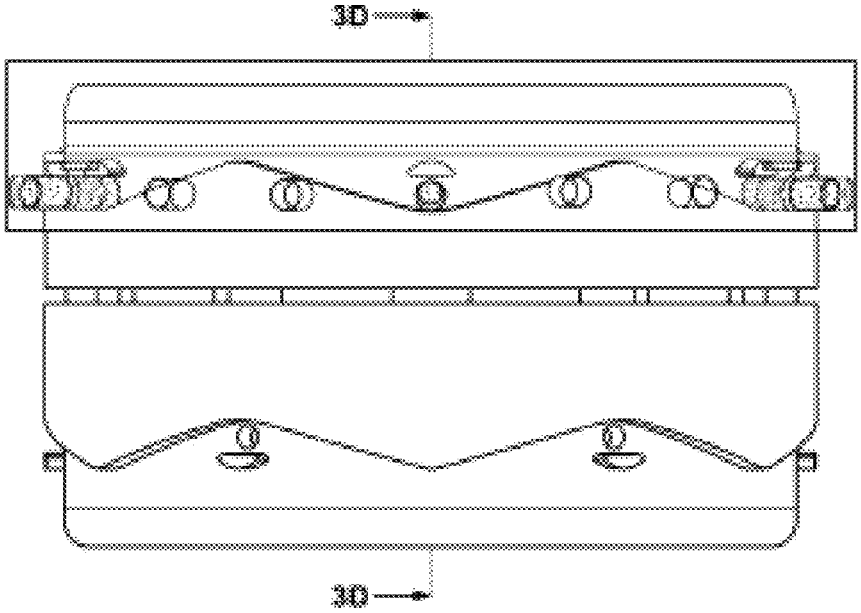
Figure 3D:
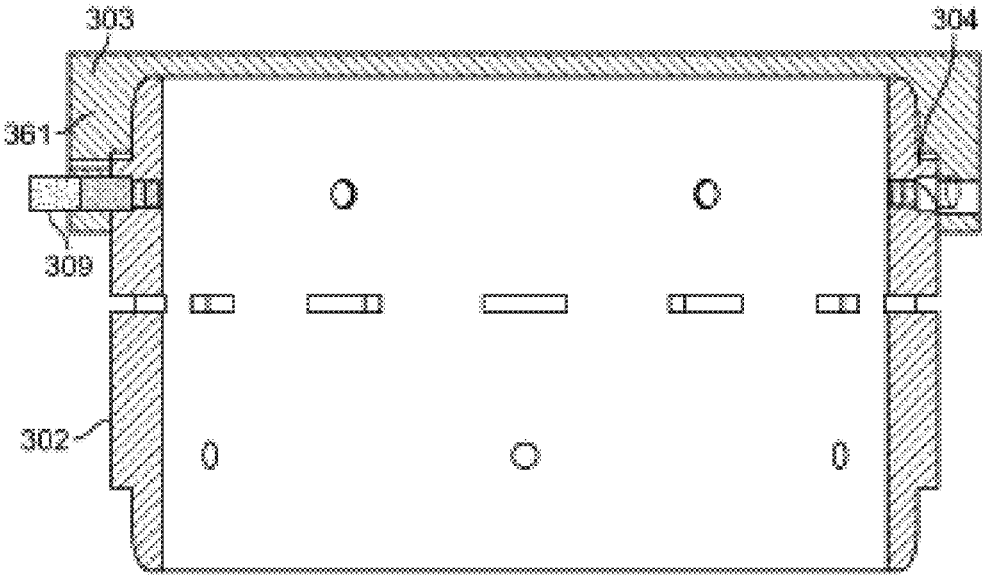

In the embodiment illustrated in FIGS. 1A-1J, article 1 is configured as a container with a hollow interior, and is therefore sometimes also referred to as "container 1". Lid 3 is shaped to be engageable with body 2, and rotatable when engaging therewith. Outer lid lip 61 descends circumferentially downward from the top of lid 3 to form a cylindrical structure shaped and sized to drop down upon and receive the upper portion of body 2, as shown in FIG. 2. Additionally, or alternatively, the body can be configured with a mouth or opening which is sized to receive the entirety of the lid such that the outer lid lip 61 is circumscribed by the walls or mouth of the body, if so desired.

Figure 5A:
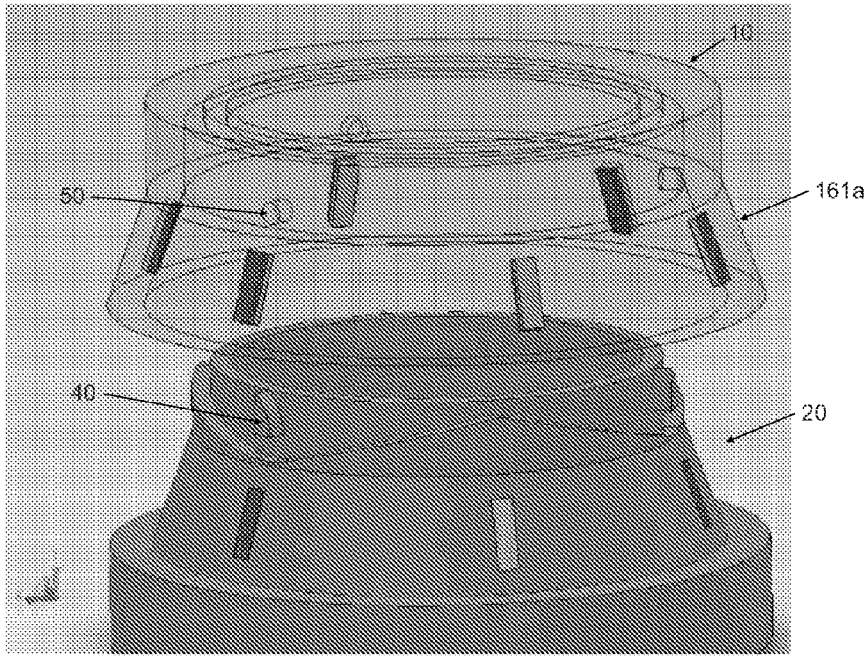
FIGS. 5A-B are perspective views of an exemplary embodiment of the disclosed subject matter depicting an alternative lid and body configuration.
Figure 5B:
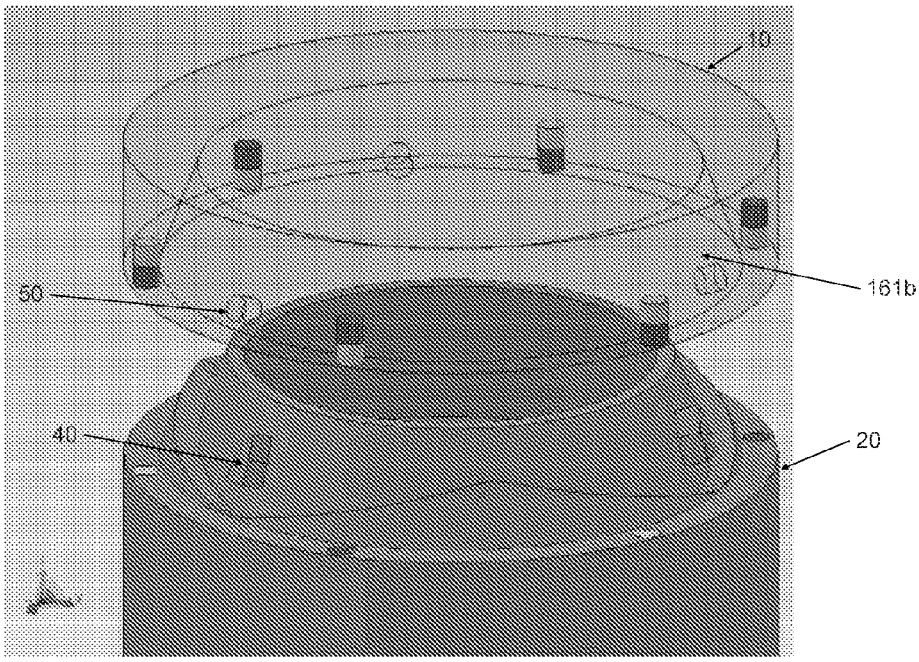

In other embodiments, as shown in FIG. 5A the lid 10 can be configured with a downward and outwardly extending outer lid lip or skirt member 161*a*, which is configured to engage a complementary shaped upper portion of the body 20. Further, and as shown in FIG. 5B, the lid 10 can be formed with an angled or diverging interior sidewall surface 161*b*. The embodiments illustrated in FIGS. 5A-B do not require an inner guide formed in the outer lid lip 161*a*, 161*b* for engaging the upper portion of the body 2. Instead, the surface contact between the outer lid lip 161*a*, 161*b* and the upper portion of the body 2 ensure proper registration of the lid and body and guide the lid into mating engagement with the body 2.

There are at least one, and in the case of this embodiment, three, first interlock pieces shaped like first interlock piece 4, disposed on body 2. In the embodiment shown in FIGS. 1A-1J, first interlock piece 4 is generally in the shape of an inverted circle segment (with some flattening on the arced underside, near area 7, where it is near horizontal), fixedly secured and protruding radially from the upper outer circumference of body 2 (or otherwise having a radial extent relative to body 2) and oriented so that its generally flat upper surface 12 is tilted downward, in this embodiment from left to right when viewed from the side and from outside of container 1. The three first interlock pieces in this embodiment comprise first interlock piece 4 and two other corresponding like pieces (visible but not separately referenced, in FIG. 1C), that are likewise fixedly disposed circumferentially around the upper outer circumference of body 2, at approximate 120 degree intervals.

There is at least one, and in the case of this embodiment, three, second interlock pieces shaped like second interlock piece 5, fixedly disposed on lid 3. In the embodiment shown in FIGS. 1A-1J, second interlock piece 5 has a cylindrical pin shape, oriented radially with respect to the axis of lid 3, and protruding inward from the inner circumference of lid outer lip 61 (or otherwise having a radial extent relative to lid 3). The three second interlock pieces in this embodiment comprise second interlock piece 5, and two other corresponding like pieces (visible but not separately referenced, in FIG. 2), likewise fixedly disposed circumferentially on the inner circumference of lid outer lip 61, at approximate 120 degree intervals.

The cylindrical pin shape of second interlock piece 5 (and its circumferentially corresponding elements) can rotatably engage the underside of first interlock piece 4 (and its circumferentially corresponding elements) when lid 3 is closed on body 2 and rotated relative to body 2. As may be seen in FIG. 1E, this rotational engagement has a rotationally defined area of interlock engagement 6, adjacent to the above-mentioned generally flat, horizontal portion (in the area of 7) of the underside of first interlock piece 4, wherein, within the area of interlock engagement 6, an interlocking portion 8 of second interlock piece 5 is disposed against an interlocking portion 7 (of first interlock piece 4 (i.e., a portion within said generally flat, horizontal underside area of first interlock piece 4).

As shown in FIGS. 1A-1J the lid and body interlock pieces 4, 5 can be fixedly coupled to lid and body members. Additionally, or alternatively, the lid and body interlock pieces can be moveably coupled to the lid and body. In the embodiment depicted in FIG. 5B, the lid interlock piece 50 is initially disposed in a refracted position housed within the lid 10 until the lid is disposed in the closed configuration, i.e. rotated and compressed downwards, the lid interlock piece 50 is actuated to extend from a recess or housing within the lid 20 to engage the body interlock piece 40. Additionally, the lid interlock piece can be configured similar to the embodiment illustrated in FIG. 4 which includes pins 605 disposed within a housing or recess 661 (note: only select pins are illustrated for sake of clarity, additional pins can be employed sa so desired.

Further, there is at least one pair of mutually attractive (or repulsive) elements (9, 10), the opposite elements of said pair being disposed respectively on body 2 and lid 3, and positioned thereon such that their position of strongest attraction to (or repulsion from) each other, as lid 3 rotates relative to body 2, approximately corresponds to the rotational position of lid 3 and body 2 when rotationally positioned in area of interlock engagement 6. In this embodiment, the mutually attractive/repulsive elements are magnets, and preferably strong rare earth magnets. The N/S polarity of the magnets is indicated by light/dark shading (which polarity is immaterial, so long as polarities are consistently treated). In the illustrative embodiment, there are three magnets 9, 9', and 9" circumferentially disposed at approximate 120 degree intervals around lid 3. Opposing magnets 10, 10', and 10" are circumferentially disposed at like intervals and radius on body 2. (Body 2 may also have additional magnets around its upper periphery, for example, magnets 21, 21' and 21", which are N/S-oriented in a direction opposite to the N/S orientation of the other body magnets 10, 10', and 10", so as to repel instead of attract magnets 9, 9', and 9"; such optional, oppositely oriented magnets will be discussed later in this disclosure.) The arrangement of magnets shown here (and like arrangements involving a greater or lesser number of magnets) may of course be reversed between the lid and the body. In the embodiment shown, paired magnets have been used. However, combinations of magnets and unmagnetized magnetic material may alternately be used in an equivalent manner as will be apparent to those of ordinary skill in the art.

As can be seen in various views in FIGS. 1A-1J, when magnets 9 and 10 are aligned, first and second interlocks 4 and 5 are also in an interlocked position. In the illustrated embodiment, this occurs when all of 4, 5, 9, and 10 are approximately aligned, but it is not necessary that interlock pair 4 and 5 be vertically aligned with magnet pair 9 and 10.

In addition, there is preferably at least one ramp 11 forming the bottom of an inset running at least partially around the upper outer circumference of body 2. The inner circumferential wall of the inset area above ramp 11 contains first interlock piece 4 as a radial protrusion into said inset. Ramp 11 is inclined relative to the top of body 2 to slope in the direction of area of interlock engagement 6, and runs beneath first interlock piece 4 in said area of interlock engagement 6, with sufficient clearance to accommodate second interlock piece 5. In this embodiment there are three circumferential ramps, comprising ramp 11 and two other corresponding like ramps (which may be seen in the various views of FIG. 1), again at approximate 120 degree intervals. Further in this embodiment (but not necessary to the invention), ramp 11 (and each of the other two corresponding ramps) comprises two sections, one on either side of first interlock piece 4, each section sloped symmetrically about first interlock piece 4, and running toward the underside and beneath first interlock piece 4. These three ramps together define a generally scalloped inset of varying elevational depth around the upper periphery of body 2. As may be implied from the above description, in this embodiment first interlock members 4, etc. protrude from the sides of body 2 into this scalloped inset, and the three areas of maximum ramp depth lie approximately beneath each of first interlock members 4 etc., providing clearance for second interlock piece 5 and its corresponding other two lid interlock pieces.

Ramp 11 is positioned on body 2 to receive second interlock piece 5 from above as lid 3 is drawn into compression with body 2 from a rotational position in which second interlock piece 5 is approaching a portion of ramp 11 from above ramp 11. Note that the disclosed subject matter will function without ramp 11. However, ramp 11 is preferred, in that it helps to engage the assistance of both gravity and magnetism in translating downward lid motion into rotation in the direction of locking, rather than relying exclusively on the magnets or other attractive/repulsive elements to induce such rotation. Additionally, threads can be provided on the downwardly extending lip of the lid and corresponding upper portion of the body to facilitate the closure of the container, if so desired. Further, the ramp and/or threads can be configured with a pitch such that the ratio of rotational movement of the lid compared to vertical displacement of the lid is 1:1, or alternatively a variable pitch can be provided, as so desired. The presence of the ramp provides a mechanical engagement of the lid and body that compliments and cooperates with the magnetic engagement of the lid and body to assist and ensure a complete closure and locking of the container assembly.

In accordance with an aspect of the disclosed subject matter, a self-actuating closure assembly is provided wherein the lid is configured to automatically initiate closure of the assembly without any effort from a user and regardless of the lid's orientation with respect to the body. In other words, a user can place or drop the lid 3 onto the body 2 wherein the lid magnets are positioned to repel the first set of body magnets which in turn causes the lid to rotate. As the lid rotates the lid magnets are brought into an attractive orientation with the second set of body magnets thereby generating an attractive force. Consequently, the lid continues to rotate until reaching the point of maximum magnetic attraction which coincides with a mechanical locking position.

In the exemplary embodiment depicted in FIGS. 1A-J, interlock piece 4 is shaped as an inverted generally circle-segment-shaped piece with an underside flatted area, and the second interlock piece 5 is shaped as a cylindrical pin which assists in a smooth closure of lid 3 onto body 2. The respective shapes of upper surface 12 of first interlock piece 4 and lower surface 13 of second interlock piece 5 are such that, in those cases when surfaces 12 and 13 contact each other during closure of lid 3 against body 2, surfaces 12 and 13 slide against each other when further urged together and rotated with lid 2 and body 3 (respectively). Said sliding is in a direction corresponding to closer engagement of lid 2 and body 3. Said shaping of surfaces 12 and 13 is further such that first interlock piece 4 and second interlock piece 5 slide off of each other at a further position of relative rotation and compression of lid 3 and body 2, above ramp 11 (and then second interlock piece 5 falls onto ramp 11 and proceeds into engagement as otherwise described herein with respect to ramp 11).

Figure 6:
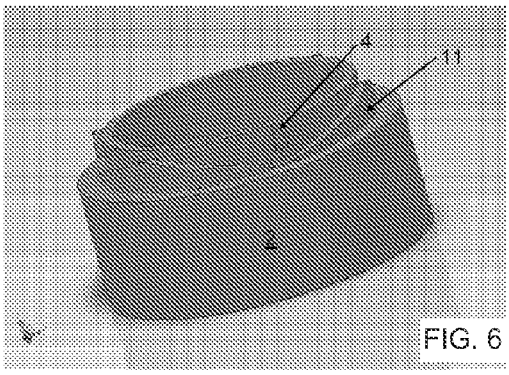
FIG. 6 is a perspective view of a body depicting an alternative body interlock piece shape.
Figure 7A:
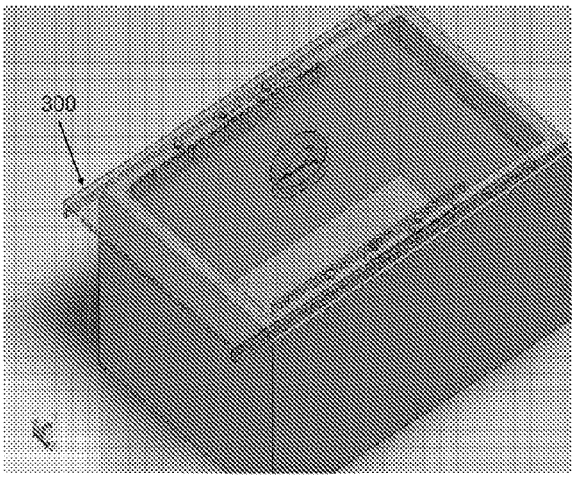
FIG. 7A-B are perspective views of an exemplary embodiment of the disclosed subject matter depicting an rectangular lid and body configuration.
Figure 7B:
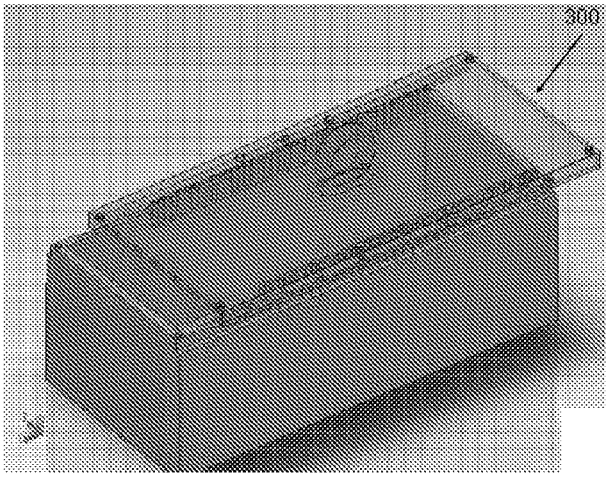
Figure 8A:
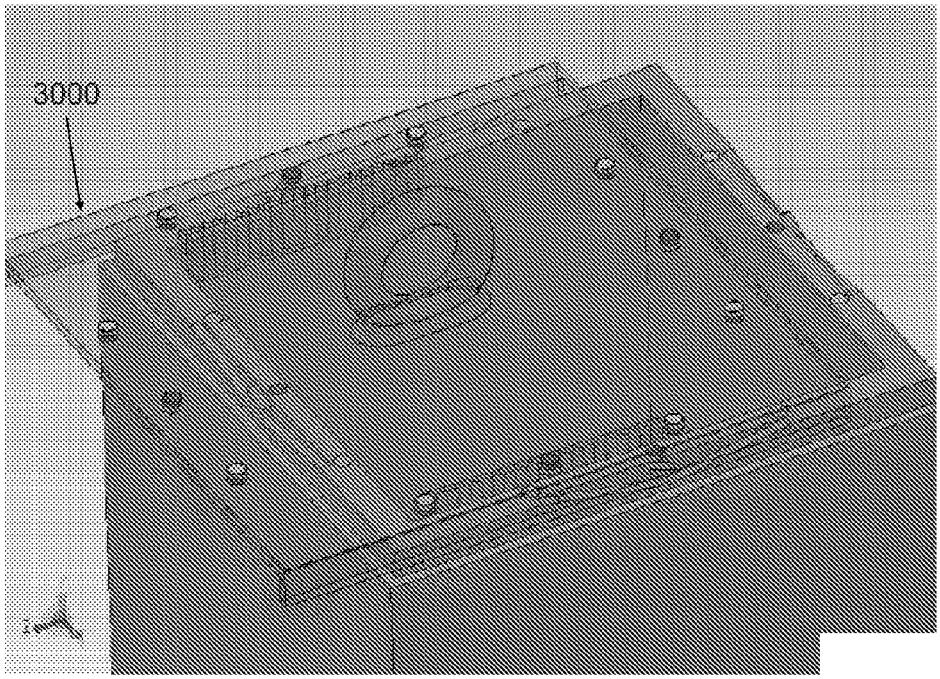
FIG. 8A-B are perspective views of an exemplary embodiment of the disclosed subject matter depicting an square lid and body configuration.
Figure 8B:
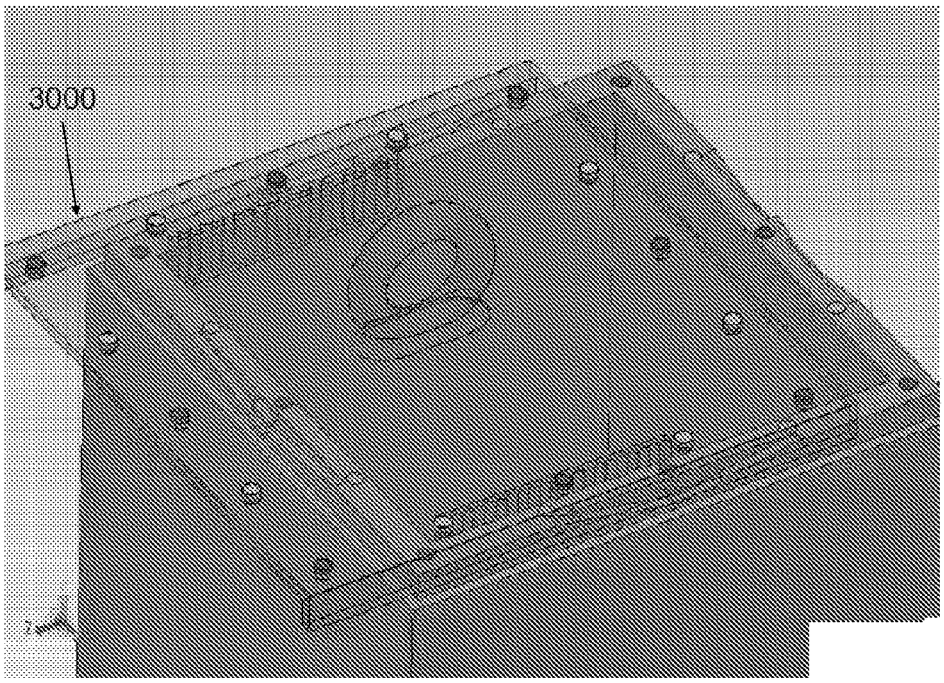

In alternative embodiments the body interlock piece 4 can be provided with a generally triangular shape in which the interlock piece extends a greater vertical distance than horizontal or circumferential distance. Additionally, the bottom portion of the interlock piece is wider than the top portion, as shown in FIG. 6. This is advantageous in that it allows the lid interlock piece 5 to move into a locked position irrespective of any pitch or angle of engagement of the lid with respect to the body. Indeed, one of the lid interlock pieces can be positioned under the body interlock piece 4, i.e. disposed in the locked position, while additional lid interlock pieces 4 are positioned above their respective body interlock pieces. Even in this scenario the magnets within the lid will repel or attract with the magnets in the body to urge the lid to rotate, which in turn will allow the out of position or raised lid interlocking pieces to rotate and drop down onto the ramp, if present, and rotate into a closed position underneath the body interlock pieces.

Preferably magnets 9, 9', and 9" will come very close to magnets 10, 10', and 10" at a closure position, but the opposing magnet surfaces preferably should not actually make physical contact. This small separation helps lid 3 maintain positive pressure against body 2 when container 1 is closed, and assists in sealing.

Body 2 may also have a central opening 32 therein defining an interior space or volume of body 2 (as would normally be the case where article 1 was, for example, a kitchen container having an interior for its contents). Preferably, lid 3 also has cylindrical inner lip 31, preferably fluted to reduce friction, disposed on the bottom of lid 3 and shaped to fit closely within the peripheral wall of central opening 32 of body 2.

When lid 3 is brought into proximity of body 2, cylindrical inner lip 31 engages the central opening 32 of body 2. Assuming lid 3 and body 2 are approximately upright, when lid 3 is let go of, it will tend to fall (primarily at first in most cases by gravity) toward body 2, preferably guided into a concentric position by cylindrical inner lip 31. As lid 3 gets close to body 2, magnets 9 and 10 (and their corresponding radial counterparts), and/or magnets 9 and 21 (and their corresponding radial counterparts) will get close enough to interact significantly. Magnets 9 and 10 mutually attract, whereas magnets 9 and 21 mutually repel. In either case, the attraction and/or repulsion serves to urge magnets 9 and 10 closer together, and interlock pieces 4 and 5 toward their locked position, and at the same time, draw lid 3 closer to body 2.

If second interlock piece 5 contacts ramp 11, these forces will tend to pull second interlock piece 5 into locked position under first interlock piece 4. If, on the other hand, in this process second interlock piece 5 comes against the upper surface 12 of first interlock piece 4, second interlock piece 5 will slide down the incline of top surface 12 of first interlock piece 4 and fall onto ramp 11, and again be drawn into locked position under first interlock piece 4. When in locked position, the interlock portion 8 on lower surface 7 of first interlock piece 4, being approximately flat, ensures that the lid remains locked, even if a container with the lid attached on is picked up from the lid.

The container in this embodiment strongly and positively resists having the lid removed other than by a specific twisting and pulling disengagement motion that rotates second interlock piece 5 out from under and clear of first interlock piece 4 (i.e., against strong magnetic force tending to keep the interlock pieces aligned), and then pulls lid 3 away from body 2 (again, against magnetic force tending to pull the lid and body together). A plain pulling force will not remove lid 2. Nor will a rocking force, lateral force, or a plain twisting force.

Preferably, repulsive magnets 21, 21' and 22' are disposed at 120 degree intervals circumferentially around body 2, at equal distances centered between magnets 10, 10' and 10". In an embodiment having one or more of these additional magnets, the body magnets are arranged in alternating polarity, to form a N-S-N-S-N-S pattern (in the case of three sets of magnets) around the upper circumference of the body. Preferably, the radial counterparts of ramp 11 intersect, i.e., have their highest points, 71, etc. in positions approximately aligned with magnets 21, 21', and 21", i.e., at positions where magnets 9, 9', and 9" will encounter approximately maximal repulsive force. This arrangement works especially well to provide a positive, automatic locking action without indefinite states, blockages, "hangs", or dead spots.

Furthermore, a seal may be provided between lid 3 and body 2. In the illustrated embodiment, such a seal is in the form of O-ring 41, seated at the body of cylindrical inner lip 31 where it joins lid 3, and against chamfer 42 on body 2 when lid 3 is in closed position on body 2. Flat sealing rings or discs could be used instead of an O-ring. O-ring 41 is dimensioned and placed so that it is approximately optimally compressed for sealing when the assembly of container 1 is in a full locked position.

Body 2 may further comprise resilient pad 51 on the bottom of body 2. This pad facilitates single-handed use of container 1. The pad provides sufficient friction against a surface such as a table or counter to overcome the attractive force of the magnets when a user twists the lid, so that the user need not necessarily hold the body with the other hand.

It is not necessary to use three lid magnets. One or more lid magnets, up to any arbitrary number, may be provided. In embodiments of this type, however, where repelling magnets are also used, there should preferably be twice the number of body magnets as there are lid magnets (or vice-versa), so they may be alternating in polarity and equally spaced, with corresponding interlock, and optionally ramp elements for each mutually attracting pair. The illustrated embodiment with three lid magnets and six body magnets is currently preferred.

Ramp 11 and first and second interlock pieces 4 and 5 and the related structures could be interchanged and/or rearranged as between lid 3 and body 2 of container 1 for equivalent operation. Similarly, lid 3 could be adapted to fit within the central opening 32 of body 2, rather than to fit over the outside top of body 2. Other variations of a similar nature will be apparent to those of ordinary skill in the art.

There are numerous other embodiments that might be developed for generally rotational closure embodiments in accordance with the principles of the disclosed subject matter.

For example, in an alternate embodiment, as shown in FIG. 3, there are three lid rod magnets 309 radially oriented and positioned in the inner lip 361 of lid 303; body 302 has six sets of ramps 311 with interlock pieces 304 centered over the lowest points of ramps 311 and body magnet 310 radially oriented in the wall of body 302 under interlock piece 304. Thus, in this embodiment, magnets 309 and 310 engage (or repel, as may be the case in a variation of this embodiment) from the side, rather than from the top. Rod magnets 309 do both the jobs of locking pins (5) and lid magnet (9) of the previously discussed embodiment, i.e. the 309 magnets engage with the body ramps 311 and once under the interlock piece 304 provide strong attraction to magnet 310, and thus provide a mechanical lock.

While the design of the embodiment shown in FIG. 3 is generally satisfactory, the incline of the upper surface of first interlock piece 4 of the embodiment shown in FIGS. 1A-1J has an advantage over the corresponding interlock structure shown in FIG. 3 because it avoids a potential "dead spot" in self-closure that exists in the embodiment in the FIG. 3 embodiment when the lid 303 is initially placed so that rod magnet 309 is very close to exactly centered over the top of first interlock piece 304, which is approximately level at the topmost portion of its upper surface. The unbroken and continuous incline of the top surface 12 of first interlock piece 4 in the embodiment of FIGS. 1A-1J avoids this particular situation.

Figure 4:
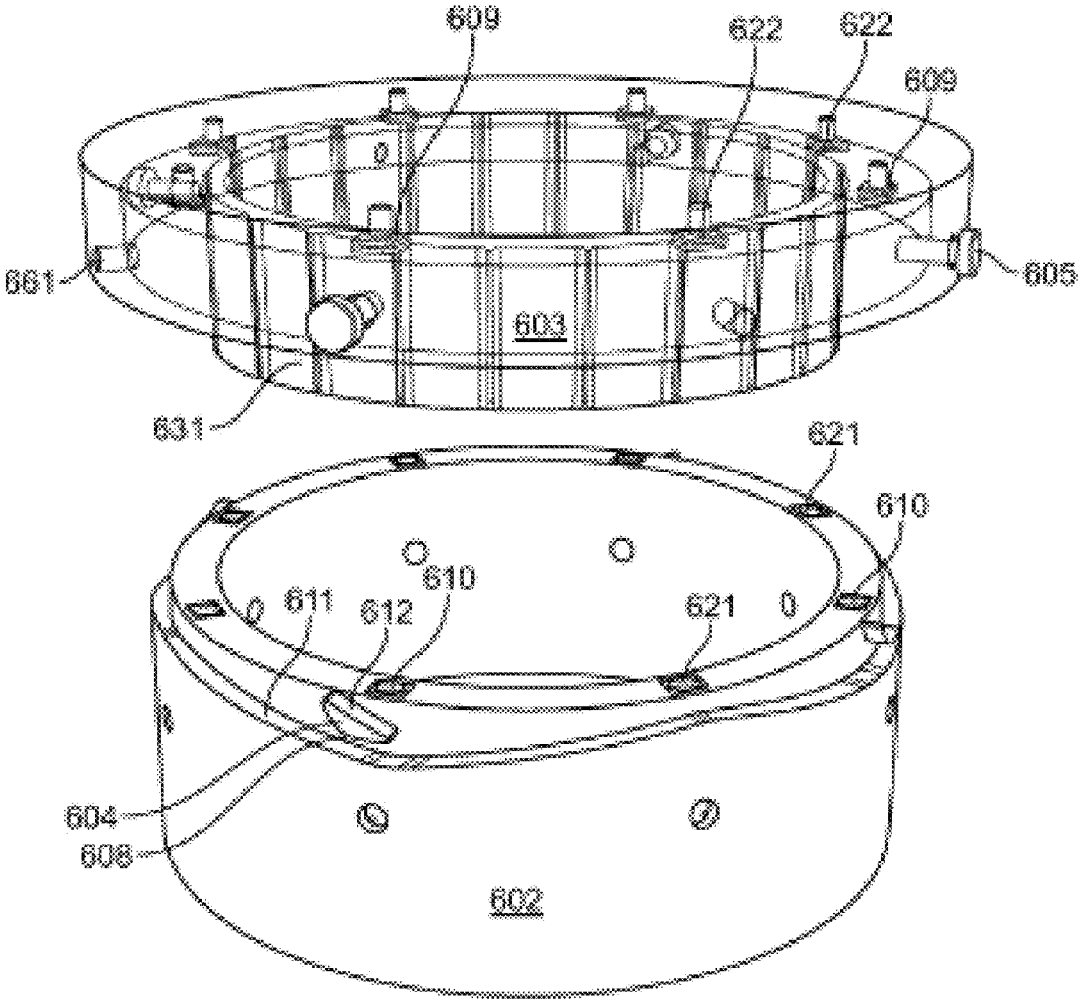
FIG. 4 shows another illustrative container in accordance with an alternate embodiment employing eight mutually attractive magnet pairs.

FIG. 4 shows another alternate embodiment having eight pairs of mutually attracting magnets, comprising four pairs 609, 610 in one N-S paired orientation, alternating around the circumference of lid 603 and body 602, with four pairs of magnets 622, 621 oriented in the opposite orientation. The first four pairs 609, 610 are respectively centered over interlocks 604, 605 and the second four pairs 621, 622 are respectively centered over the top-most areas of ramps 611.

It should be apparent that the various embodiments of the disclosed subject matter may be used for any type of rotating closure not necessarily associated with a cylindrical container, such as a gas tank or other filler cap, vent cap, or the like.

In addition, the principles of the disclosed subject matter could also be adapted to non-circular geometries, wherein a channel analogous to ramp 11 is linear, and, for example, there are two parallel rows of alternating opposing magnets rather than a circular arrangement. For example, FIGS. 7A-8B depict alternative embodiments of the disclosed subject matter (i.e. a square FIGS. 7A-B and rectangular FIGS. 8A-B container assembly) in which the lid 3000 and body 2000 are configured for relative linear movement to effect opening and closing of the container assembly. In operation, the user releases the lid above the body and with the lid magnets disposed proximate the body magnets such that the magnetic interaction causes the lid to slide along the body while the ramp causes the lid to compress downwards on the body to bring the interlocking pieces into engagement upon closure of the container. Once secured in the locked position, the user can lift the container assembly by a handle member provided on the lid, if so desired. The maximum load capacity of the container that the handle can support is dependent on the mechanical stress limits of the interlock pieces 4,5. In order to open the container, a user pushes the lid to the left or right to overcome the magnetic attracting force of the magnets and displace the lid with respect to the body. As shown, the body 2000 includes ramps on all four sides of the container. Accordingly, the lid can be secured to the body through engagement of a first pair of opposing sides, or rotated ninety degrees and attached to the body via the other pair of opposing sides. While the lid depicted in these embodiments is capable of being completely detached from the body, other embodiments can include a retaining feature or end stop to prevent the lid from sliding off and being detached from the body, if so desired.

Similarly, as mentioned above, in a rotating engagement embodiment, first and second interlock pieces 4 and 5 need not be aligned with magnets 9 and 10, but can be offset at any angle relative to the axis of a circular mechanism or relative to the length of a linear mechanism, so long as positioned so that second interlock piece 5 comes into alignment with first interlock piece 4 when magnets 9 and 10 (or corresponding mutually attractive elements) are aligned, in which case the deepest point of ramp 11 (or corresponding element) would also be moved to align with the lock position defined by the first and second interlock pieces. Furthermore, interlocking pieces 4 and 5 could be interchanged with other interlocking elements known to those of skill in the art, including without limitation hooks, latches, interlocking grooves and the like.

The embodiments shown in detail here have mutually attractive elements, in this case magnets, disposed differently, in one case to engage along a radius and in another case to engage axially. These are select representations of numerous workable arrangements of mutually attractive or repulsive elements, and others that provide both forces to draw the closure pieces together and move them into locking alignment by rotation or sliding will be readily apparent to those of skill in the art. As previously mentioned, combinations of magnets and unmagnetized magnetic material may also be used as an alternative to magnet pairs.

As explained, a self-actuated closure in accordance with the present disclosed subject matter overcomes the shortcomings of the prior art in many respects. It only requires the placement and release of the lid (or other closing element) in order for it to automatically lock and seal. It does not require manual application of specific force to achieve a lock and seal, and can provide a positive and effective seal for a wide range of containers and contents. It can close automatically in a smooth and predictable manner, avoiding "blocked" or "hung" states in which closure stops short of full engagement. It can engage in a manner that provides strong, positive resistance to disengagement other than by means of a specific disengaging operation, and the disengaging operation involves different forces and movements than those resulting from routine storage and handling. The closure mechanism is readily capable of incorporating a positive seal for solid, liquid and/or gaseous contents.

Figure 9A:
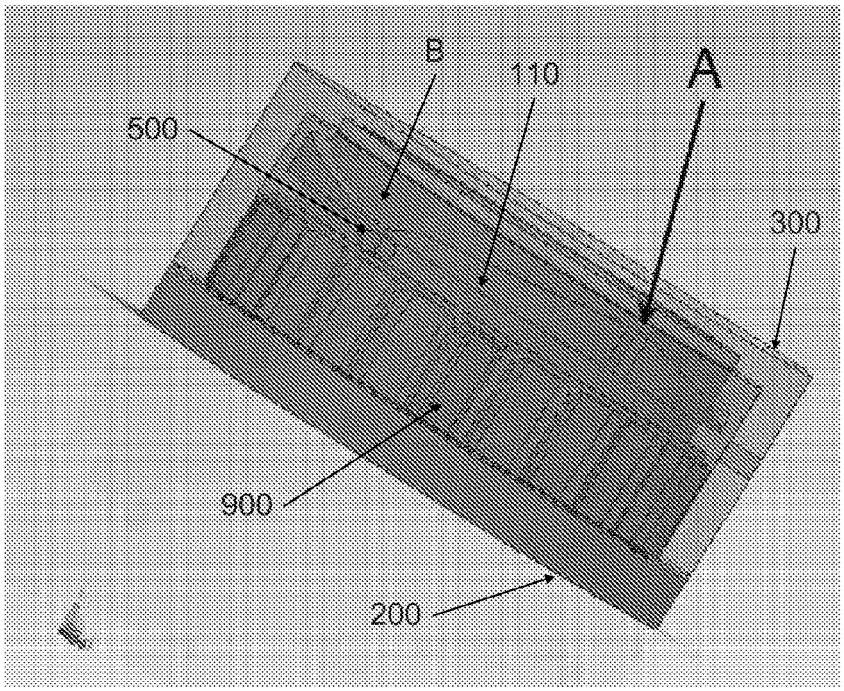
FIGS. 9A-B are side and perspective views of an alternative embodiment of the disclosed subject matter depicting a guide channel.
Figure 9B:
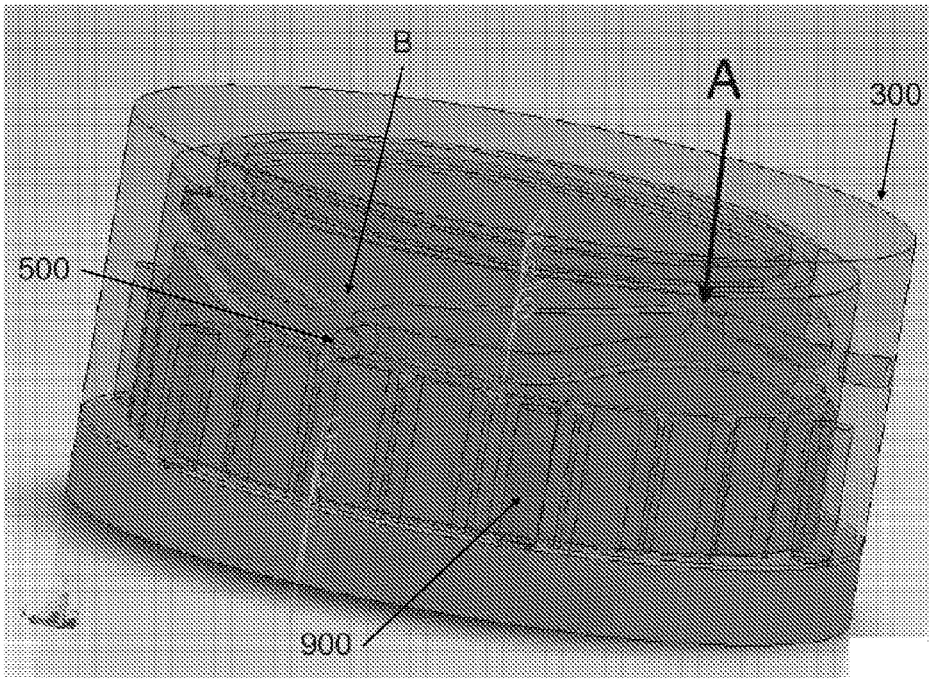

In accordance with another aspect of the disclosed subject matter, the lid 300 is provided with a weight which is less than the repelling or push force generated by the opposing magnets 900, 1000, 2100, when positioned in a repelling configuration. In the exemplary embodiment shown in FIGS. 9A-B, the lid 300 has vertically oriented magnets 900 disposed in a downwardly extending sidewall which overlies the sidewall of the body 200. The body 200 includes corresponding magnets in a lip formed at the bottom of the body which are aligned with the magnets in the lid, when in the container assembly is in the closed position.

Additionally, the ramp 110 can be configured as a guide channel or slot extending around at least a portion of the periphery of the body and configured to receive the lid interlocking piece 500 and guide the trajectory of the lid interlocking piece during relative movement between the lid an body. The ramp 110 or guide channel includes a plurality of discontinuities or gaps that allow for the lid interlocking piece 500 to pass through for entry into and exit from the guide channel. As the user rotates the lid with respect to the body, the lid interlocking piece 500 travels along the trajectory of the ramp and displaces the lid either upwardly or downwardly. Once the lid interlocking piece 500 reaches the gap "A" in the ramp the lid magnets are in a repulsive relationship to the body magnets wherein the repulsive forces urge the lid upward such that the lid is unlocked and disengaged from the body.

The repulsive forces of the magnets can be selected such that the lid is lifted or buoyed above the body at the gap "A". In other words, the lid interlock piece remains suspended above the entrance point of the guide channel when at position "A". This prevents the lid from snagging or being caught by the gap in the guide channel. Accordingly, the lid remains available for rotation by a user to bring the lid magnets into an attractive orientation with respect to the body magnets to thereby initiate the closing of the container assembly. Furthermore, the magnitude of the repulsive force can be chosen such that during an opening procedure a tactile and/or auditory notification is provided to the user that the lid interlock piece has passed through the gap "A" to unlock and disengage the lid from the body.

Figure 10:
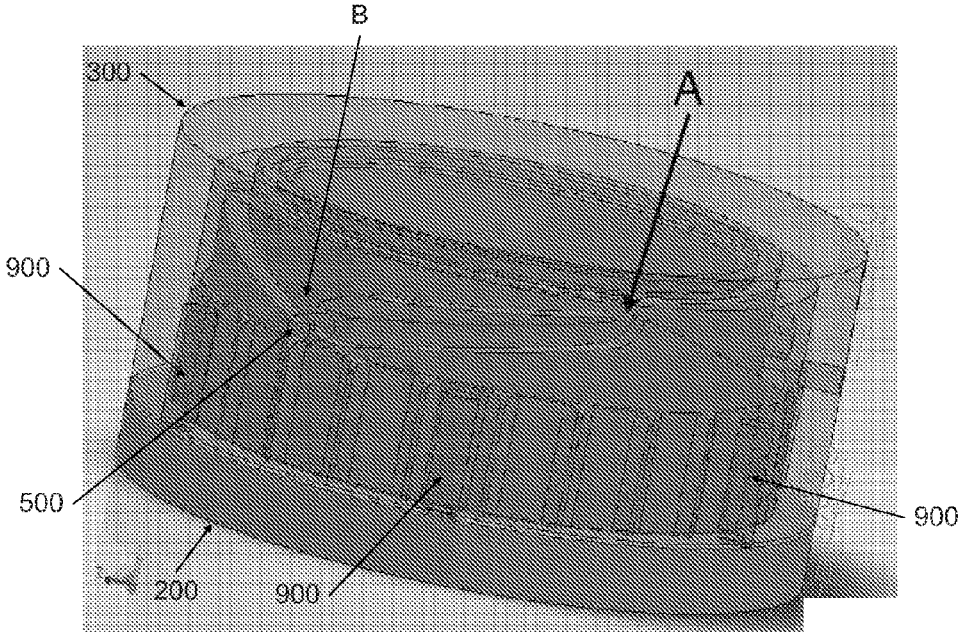
FIG. 10 is a perspective view of an alternative embodiment of the disclosed subject matter depicting another guide channel configuration.

In accordance with another aspect of the disclosed subject matter, the container assembly can be provided with a deliberate and distinct pathways or trajectories within the guide ramp or channel 110 for opening and closing of the container assembly. In the embodiment illustrated in FIG. 10, the lid interlocking piece enters the ramp or guide channel at location "B". As the user rotates the lid anticlockwise the lid interlock piece 500 the ramp or guide channel 110 prevents release of the lid until the lid interlock piece reaches a predetermined exit or release point "A".

Furthermore, the ramp or guide channel 110 can include a plurality of structural features which serve as an obstruction or interruption to the trajectory of the lid interlock piece 500 during the opening or closing of the container assembly. Accordingly, the interruptions and obstructions require the lid interlock piece 500 to travel along a disjointed or non-linear path from the entry point to the exit point within the guide channel 110. This embodiment serves as a child-proof container assembly in that the opening of the container assembly requires significant logic, dexterity or strength to overcome or navigate through the various pathways defined in the guide channel. This can be advantageous in applications of the container assembly in which pharmaceutical or other potentially hazardous materials are stored in the container. Moreover, the magnets can be arranged within the lid and body to provide a repulsive force during opening of the container to assist and facilitate lifting and release of the lid which can be particularly useful for the elderly or physically impaired.

Figure 11:
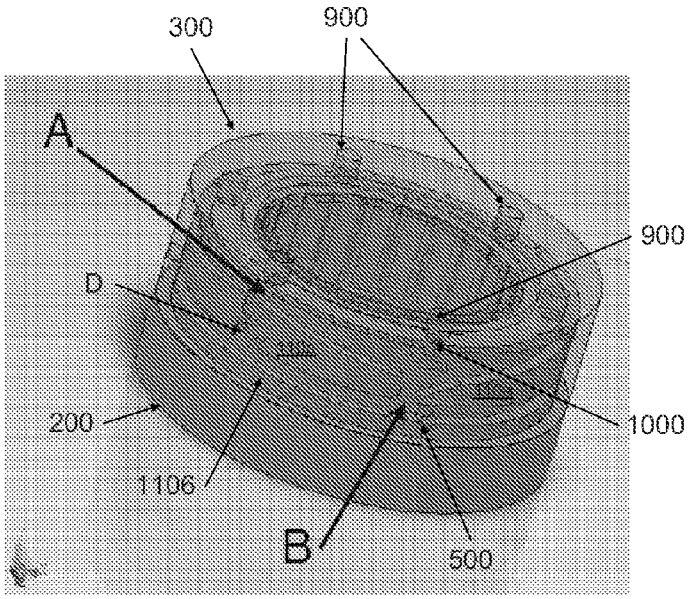
FIG. 11 is a perspective view of an alternative embodiment of the disclosed subject matter depicting another guide channel configuration having a plurality of pathways.

In the exemplary embodiment illustrated in FIG. 11, the lid interlock piece 500 is received within guide channel 110 disposed between elements 110*a*, 110*b*. In the embodiment shown, the guide channel is configured without an angled or ramp-like shape to mechanically urge the lid interlock piece in a vertical direction. Consequently, when the lid is rotated to location "B" as shown in FIG. 11, thus bringing lid magnets 900 into alignment and point of maximum attraction with body magnets 1000, the lid will not lift upwardly via mechanical interaction of the lid and body to overcome the magnetic attractive force between the lid and body. Therefore, considerable force must be exerted by the user to overcome the magnetic attraction in order to remove the lid from the body when in this position. Further, in the event the user were able to overcome the magnetic attraction and lift the lid interlock piece out of the guide channel, the body interlock piece 400 would serve to inhibit or prohibit the passage of the lid interlock piece 500 and thus inhibit or prevent release of the lid from the body. Additionally, an additional structure (not shown) can serve as a gate which allows the lid interlock piece to pass downwardly into the guide channel at location B, but prevents the lid interlock piece from exiting the guide channel at location B. Therefore, a user must rotate the lid to bring the lid interlock piece to an available exit pathway, e.g., at location D, as discussed in further detail below.

The arrangement of the magnets coupled to the lid and body can be configured such that the location of the exit point, or pathway, in the guide channel 110 determines whether there is attractive, repulsive, or negligible magnetic force acting on the lid. In the embodiment shown in FIGS. 11-12B, the magnets are attractive when the lid magnets 900 are aligned with the body magnets 1000 to urge the lid downward and along the sloped surface of guide channel 110*a* at location "B" in FIG. 11. Once the user begins the opening procedure, the lid is rotated to bring the lid interlock piece 500 to the start of exit path "D", which coincides with the magnets providing a repulsive force. Accordingly, when the user rotates the lid to bring the lid interlock piece 500 to location "D" the repulsive magnetic force urges the lid upwards causing the lid interlock piece to enter the exit path of the guide channel. Once introduced into the exit pathway the lid interlock piece 500 encounters a structural obstruction "C" (best shown in FIG. 12B) which interrupts the vertical trajectory of the lid interlock piece 500, thereby requiring the user to apply a rotation force in order to rotate the lid to bypass the obstruction "C". However, due to the repulsive magnetic force urging the lid upward and into the obstruction "C", the user must couple the applied rotational force with a slight downward force to compensate or negate the magnetic force and allow for the lid interlock piece 500 to divert around the obstruction "C".

Figure 12A:
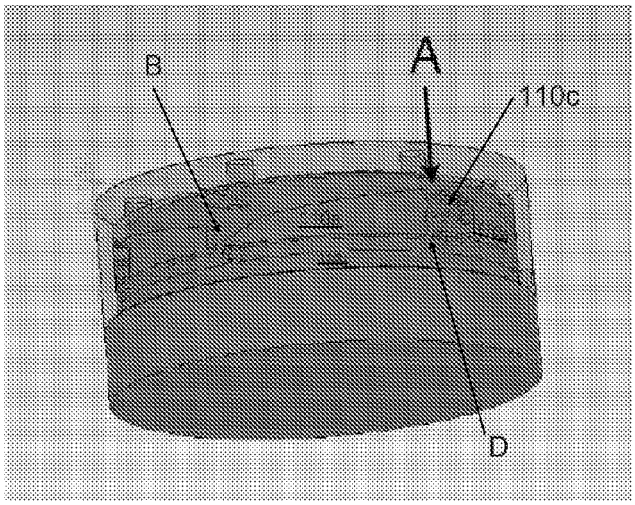
FIGS. 12A-B are perspective and detailed views of the embodiment illustrated in FIG. 11.
Figure 12B:
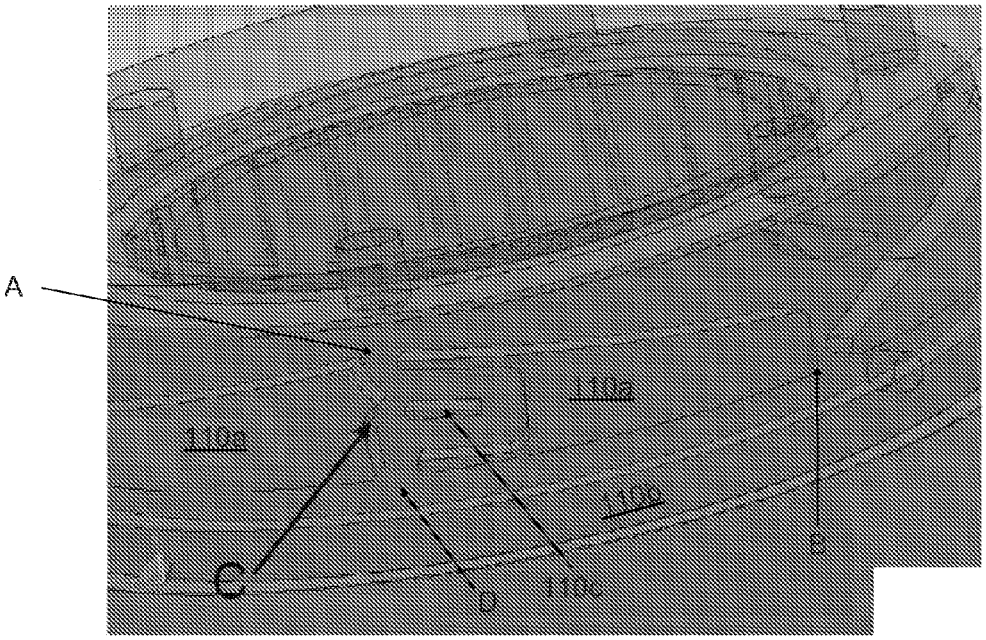

In the embodiment depicted in FIGS. 11-12B, the exit pathway is defined by the guide member 110*a*, 110*c* such that the user must rotate the lid counterclockwise to pass beneath portion 110*c*, once the lid interlock piece advances beyond 100*c* the repulsive magnetic force urges the lid interlock piece 500 upwardly and above portion 100*c*. Thereafter, the user rotates the lid clockwise to bring the lid interlock piece 500 to exit location "A" wherein the repulsive magnetic force urges the lid upwards to open the container assembly. Although the embodiment illustrated depicts a single entry path (beginning at point "B") and an exit path having a plurality of segments (proceeding from "D" through "C" and exiting at "A"), the guide channel 110 can be configured with additional or alternative pathways, as so desired.

Figure 13:
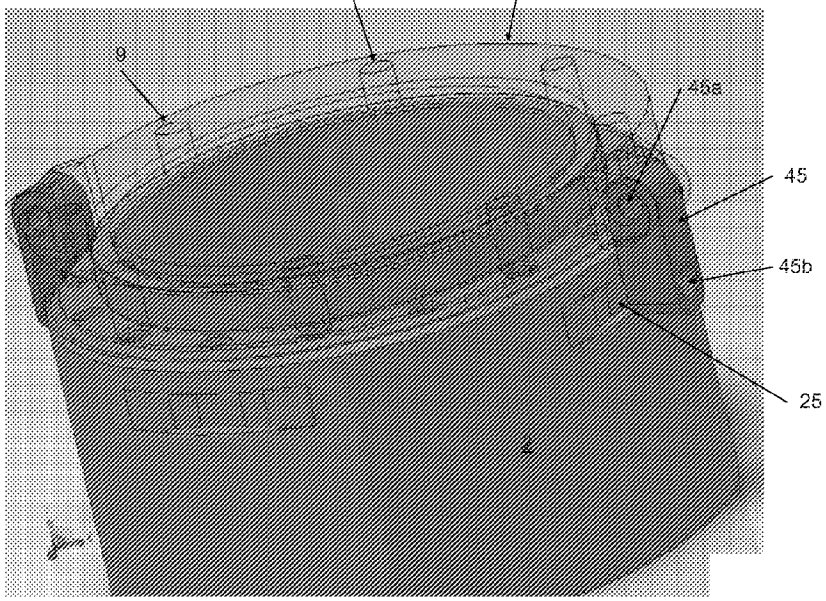
FIG. 13 is a perspective view of an alternative embodiment of the disclosed subject matter incorporating a locking mechanism.

In accordance with another aspect of the disclosed subject matter, a lever or locking member can be included in the container assembly, as shown in FIG. 13. The locking member can be provided with an additional magnet such that the lever 45 is actuated upon rotation of the lid. The lever can be fixedly mounted at one end to either the lid or the body, with the opposite end of the lever housing a magnet and configured to releasably engage the container assembly. As illustrated, the lever is hingedly attached to the lid at 45*a* to allow the lever to pivot outwardly. Further, a magnet is disposed within the lever at end 45*b* with a north pole disposed for attraction to the body magnet 10 when in a locked position. Additionally, the body 2 can include a recess 25 for receiving the lever 45*b*, which can include a male and female union to enhance the strength of the lock. When the container is rotated into the closed configuration the lid magnets 9 are aligned with the body magnets 10 to compress the lid onto the body via magnetic and mechanical interaction, as described in further detail above. Simultaneously, the lever magnet 45*b* is attracted towards body magnet 10 to actuate the lever to collapse down and lock the container assembly in the closed position. Upon rotation of the lid to open the container assembly, the lid magnets 9 and body magnets 10 are moved out of alignment and into a repulsive orientation, thereby forcing the lid upwards (for embodiments which include the ramp feature 11 described above). Simultaneously, the magnet 45*b* disposed in the lever is brought into a repulsive arrangement with the body magnet 10 to cause the lever to actuate upwardly, thereby unlocking the container assembly.

Figure 14A:
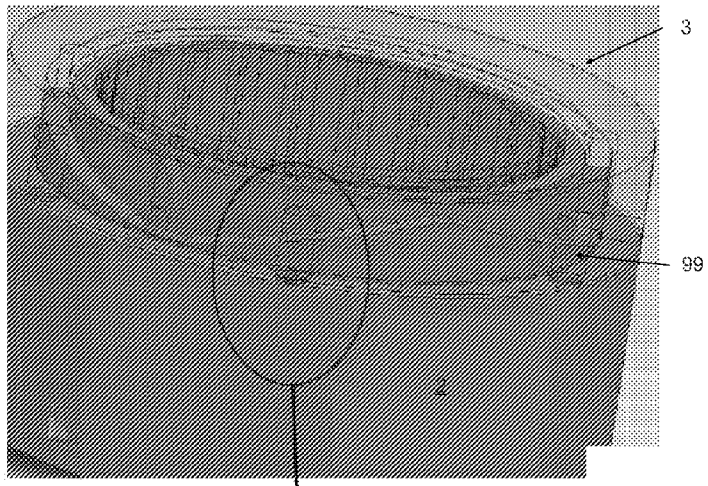
FIGS. 14A-B are a perspective view and cross-sectional view of an alternative embodiment of the disclosed subject matter depicting a moveable and lockable magnet member.
Figure 14B:
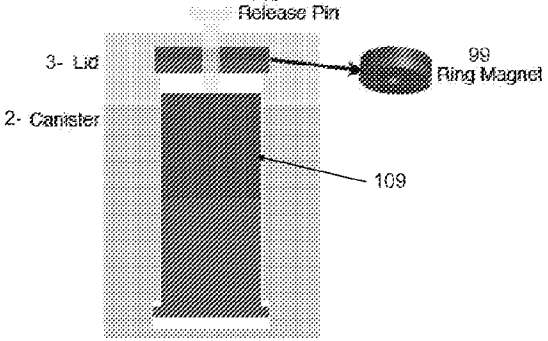

In accordance with yet another aspect of the disclosed subject matter, an alternative locking mechanism can be incorporated into the closure assembly. As shown in FIGS. 14A-B, a moveable magnet 109 disposed within the body 2 can serve as a locking means. Upon rotation of the lid 3 the ring magnet 99 disposed within the lid is brought into alignment with the moveable magnet 109 disposed within the body, thereby generating a magnetic attraction which causes the moveable magnet to advance upwardly and extend into a recess within the lid. When in this extended position, the moveable magnet 109 serves as a locking pin to prevent relative movement of the lid and body.

Additionally, a release pin 119 can be slidably retained within the ring magnet 99 disposed in the lid. Once the moveable magnet 109 advances upward and contacts the ring magnet 99, the release pin 119 can be advanced upward through an aperture in the ring magnet to extend above the upper surface of the lid and thereby provide a visual confirmation that the container is in a locked configuration, as shown in FIG. 14B. Furthermore, a user can depress the release pin 199 to mechanically urge the moveable magnet 109 downward a distance sufficient to clear the plane of the body, thus allowing rotation of the lid in order to open the container assembly.

It is apparent, therefore, that the disclosed subject matter meets the objectives set forth above and provides a number of advantages in terms of ease of use and effectiveness, over the prior art. Although the present disclosed subject matter has been described in detail, it should be understood that various changes, substitutions, and alterations may be readily ascertainable by those skilled in the art and may be made herein without departing from the spirit and scope of the present disclosed subject matter as defined by the claims.

While the disclosed subject matter is described herein in terms of certain preferred embodiments, those skilled in the art will recognize that various modifications and improvements may be made to the disclosed subject matter without departing from the scope thereof. Moreover, although individual features of one embodiment of the disclosed subject matter may be discussed herein or shown in the drawings of the one embodiment and not in other embodiments, it should be apparent that individual features of one embodiment may be combined with one or more features of another embodiment or features from a plurality of embodiments.

In addition to the specific embodiments claimed below, the disclosed subject matter is also directed to other embodiments having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other embodiments having any other possible combinations. Thus, the foregoing description of specific embodiments of the disclosed subject matter has been presented for purposes of illustration and description. It is not intended to be exhaustive or to limit the disclosed subject matter to those embodiments disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

The invention claimed is:

1. A container assembly comprising:

a body, the body including a bottom and at least one sidewall extending generally upwardly, the body including a body interlock piece protruding in a normal direction with respect to the body, the body interlock piece having an inclined top surface;

a lid, the lid including a lid interlock piece protruding in a normal direction with respect to the lid and configured to releasably engage the body;

a first magnet, the first magnet coupled to the body;

a second magnet, the second magnet coupled to the lid;

wherein the first and second magnet generate a first relative movement of the body and lid in a first direction when the first and second magnet are in a first orientation, the first relative movement operatively engaging the lid interlock piece with the body interlock piece; and wherein the first relative movement of the body and lid generate a second relative movement of the body and lid in a second direction.

2. The container of claim 1, wherein the relative movement in the second direction is generally orthogonal to the relative movement in the first direction.

3. The container of claim 1, wherein the relative movement in the first direction is generally rotational movement.

4. The container of claim 1, wherein the relative movement in the first direction is generally linear movement.

5. The container of claim 1, wherein the second relative movement displaces the lid generally downward with respect to the body.

6. The container of claim 1, wherein the body interlock piece has a top and bottom portion, the bottom portion having width greater than the top portion.

7. A container assembly comprising:

a body, the body including a bottom and at least one sidewall extending generally upwardly, with a guide portion extending a distance along a periphery of the body;

a lid, the lid configured to matingly engage the body and having a lid interlock piece, the lid interlock piece slidingly received in the guide portion of the body;

a first magnet, the first magnet coupled to the body;

a second magnet, the second magnet coupled to the lid;

wherein the first and second magnet generate a repelling force when the lid is in a first orientation with respect to the body;

wherein the repelling force is greater than the weight of the lid.

8. The container of claim 7, wherein the lid interlock piece matingly engages the guide portion at a first location of the body.

9. The container of claim 7, wherein the lid interlock piece disengages the guide portion at a second location of the body.

10. The container of claim 9, wherein the first and second magnet generate a first relative movement of the body and lid in a first direction at the first location of the body; and wherein the first and second magnet generate a second relative movement of the body and lid in a second direction at the second location of the body.

11. The container of claim 10, wherein the relative movement in the first direction is generally rotational movement.

12. The container of claim 10, wherein the relative movement in the first direction is generally linear movement.

13. The container of claim 10, wherein the second relative movement displaces the lid generally upward with respect to the body.

14. A container assembly comprising:

a body, the body including a bottom and at least one sidewall extending generally upwardly;

a guide portion extending along at least a portion of a periphery of the body, the guide portion including at least a first and second path, wherein at least one of the first and second paths include at least one obstruction;

a lid, the lid including a lid interlock piece and configured to releasably engage the guide portion, the lid interlock received in a first path of the guide portion during closure of the container and the lid interlock received in a second path of the guide portion during opening of the container;

a first magnet, the first magnet coupled to the body;

a second magnet, the second magnet coupled to the lid;

wherein the first and second magnet generate a first relative movement of the body and lid in a first direction when the first and second magnet are in a first orientation; and wherein the first and second magnet generate a second relative movement of the body and lid in a second direction when the first and second magnet are in a second orientation.

15. The container of claim 14, wherein at least one the first and second paths is non-linear.

16. The container of claim 14, wherein the guide portion includes a plurality of second paths.

17. The container of claim 14, wherein the relative movement in the first direction is generally rotational movement.

18. The container of claim 14, wherein the second relative movement displaces the lid generally upward with respect to the body.

* * * * *